US010037007B2

(12) United States Patent
Fender

(10) Patent No.: US 10,037,007 B2
(45) Date of Patent: Jul. 31, 2018

(54) APPARATUS FOR CREATING A MULTI-PURPOSE COMPOSITE IMAGE

(71) Applicant: Charles R. Fender, The Villages, FL (US)

(72) Inventor: Charles R. Fender, The Villages, FL (US)

( * ) Notice: Subject to any disclaimer, the term of this patent is extended or adjusted under 35 U.S.C. 154(b) by 0 days.

(21) Appl. No.: 15/688,810

(22) Filed: Aug. 28, 2017

(65) Prior Publication Data

US 2018/0039230 A1 Feb. 8, 2018

Related U.S. Application Data

(63) Continuation-in-part of application No. 14/643,407, filed on Mar. 10, 2015.

(51) Int. Cl.
*G04B 45/00* (2006.01)
*G04B 19/04* (2006.01)

(52) U.S. Cl.
CPC ..... *G04B 45/0023* (2013.01); *G04B 19/046* (2013.01)

(58) Field of Classification Search
CPC ..... G09F 11/02; G09F 11/04; G09F 11/23; G09F 11/232; G09F 11/235; G09F 19/02; G04B 19/046; A63H 33/22
See application file for complete search history.

(56) References Cited

U.S. PATENT DOCUMENTS 1,025,969 A * 5/1912 Flegel ..... A63H 33/22 446/149
1,530,404 A * 3/1925 Pearce ..... A63H 33/22 273/155
1,738,398 A * 12/1929 Sesti ..... G09F 11/04 434/78
2,000,153 A * 5/1935 Watson ..... G01P 3/40 235/116
2,513,100 A * 6/1950 Muri ..... G09F 11/23 40/435
2,728,167 A * 12/1955 Knott ..... A63F 9/0819 273/155
2,755,577 A * 7/1956 Greensfelder ..... A63H 33/22 273/155
3,142,919 A * 8/1964 Richardson ..... G09F 11/23 40/421

(Continued)

*Primary Examiner* — Gary Chapman Hoge
(74) *Attorney, Agent, or Firm* — Bycer Law, PLC; Matthew L. Bycer

(57) ABSTRACT

Apparatus for telling time by aligning a plurality of partial images from time to time to form a composite image, including a motor having two or more concentric rotating output shafts rotating at different speeds. Each of the partial images is supported by one of the shafts. As a function of the relative rates of rotation of the shafts, all of the partial images become aligned from time to identifiable time to form the composite image.

Each and every rotating disc in these examples is attached to a power driven shaft. This is a common concentric shaft with three differing powered rotations, one at sixty rotations per hour, another at two rotations per twenty-four hours, and the remaining one at 3600 rotations per hour. These rotating discs are identified respectively as the minute disc, the hour disc, and the secondhand disc and are attached to their respective individual shafts.

24 Claims, 10 Drawing Sheets

(56) References Cited

U.S. PATENT DOCUMENTS

| | | | | | |
|---|---|---|---|---|---|
| 3,526,983 | A * | 9/1970 | Klauber | G09F 13/36 | 40/433 |
| 3,900,978 | A * | 8/1975 | Sloan | G09F 11/04 | 40/435 |
| 4,341,035 | A * | 7/1982 | Jaworski | A63H 33/22 | 40/587 |
| 4,945,522 | A * | 7/1990 | Radel | G04B 19/046 | 368/233 |
| 5,281,145 | A * | 1/1994 | Sidrak | G09B 23/04 | 434/211 |
| 5,669,165 | A * | 9/1997 | Santorsola | G09F 11/23 | 116/316 |
| 6,009,647 | A * | 1/2000 | Feingold | G09F 11/04 | 40/430 |
| 6,272,776 | B1 * | 8/2001 | Santorsola | G09F 11/23 | 116/316 |

* cited by examiner

APPARATUS FOR CREATING A MULTI-PURPOSE COMPOSITE IMAGE

CROSS REFERENCE TO RELATED APPLICATION

The present application includes subject matter disclosed in and claims priority to application Ser. No. 14/643,407 entitled "Apparatus for Creating a Composite Image", filed Mar. 10, 2015, herein incorporated by reference, and describing an invention made by the present inventor.

BACKGROUND OF THE INVENTION

1. Field of the Invention

The present invention relates to continuous rotating partial images which when aligned present a vivid composite image which through alternating orientation becomes an accurate continuous time-telling device.

2. Description of Related Prior Art

Sports fans are often avid collectors of sports memorabilia in the form of posters, pins, decals, hats, etc. depicting a sports team logo. Very often an image cherished by a sports fan is that of a player, a team or even a park setting wherein the pertinent game is played. Similarly, corporations advertise their goods or services through a medium of a logo. In the field of entertainment, images of cartoon characters, actors, actresses, musicians, bands, etc. are depicted on posters or the like and cherished. In the field of politics, images of candidates or aspiring politicians are depicted on posters, cards, and other surfaces to promote a candidate or a particular political party. A list of images cherished or lauded by segments of the population is endless as it includes all aspects of human interests.

One of the difficulties or drawbacks of presently available images is that they are static. That is, except for rare occasions, these images are immobile and do nothing to draw attention to them other than the subject matter depicted. After a period of viewing, these images generally become boring. This is true even for avid collectors of images and persons who view these images for inspiration or adoration.

The fate of the plain classic analog watch/clock could be similarly described. In recent years these time telling devices have undergone a noticeable revision. Wrist watches have grown huge with time related gadgetry prominently displayed on the faces. The standard Roman numeral classic clock face in its simple original form is seldom seen.

This invention utilizes this analog watch/clock mechanism in a unique fashionable manner to give eye catching movement to a message of interest while accurately stating the time of day.

SUMMARY OF THE INVENTION

The present invention is directed to two partial images, when aligned with one another, to form a composite image. The subject matter of such composite image may be a depiction of any subject. Each partial image is attached to one of a plurality shaft of concentric shafts. A motive means, such as an electric motor, rotates each at a different selected speed. As a result, one of the partial images will become aligned with the other partial image at each rotation in excess of 360° and depict the composite image. For greater complexity, three partial images may be mounted on concentric shafts wherein each shaft rotates at a different speed. As a function of the respective rates of rotation, these partial images will become aligned from time to time to display a composite image which due to its predictable changing orientation/position will serve as a clock/watch—a time telling device. Between the reappearance of the registered composite image, when the components of the design seem unrelated or even hodgepodge, the accurate telling of time is still readable to the astute viewer versed in the overall operation. Those unfamiliar with the process will, in most cases, be unable to determine the time of day by way of a quick glance, thereby privatizing the relationship between the device and its proprietor.

Temporary markers can be affixed to the discs, and may also include removable markers to be removed once the pattern of the movement is learned.

With the analog watch/clock movement the direct overlapping of hands occurs twenty-two times per day. Therefore, the total composite image would be established at 1:05.27, 2:10.55, 3:16.22, 4:21.49, 5:27.16, 6:32.44, 7:38.11, 8:43.38, 9:49.05, 10:54.33, and 12:00.00. This would repeat for both AM and PM hours thereby allowing for accurate telling, or educated guessing, of time.

It is therefore a primary object of the present invention to provide mobile partial images rotating about a controllable common axis to display a composite image which will serve as a time-telling device. A first (partial) image may move around as an hour hand, making one or preferably two revolutions per day, while a second (partial image) may act as a minute hand making twenty-four revolutions per day, and an optional third (partial) image may act as a second hand making roughly one thousand four hundred forty revolutions per day.

Another object of the present invention is to provide a first rotating partial image and a second rotating partial image rotating about a common axis to display a composite image composed of a desired artist developed composition, ranging from photographic realism to non-objective compositions.

Yet another object of the present invention is to provide a first rotating partial image and a second rotating partial image to form a composite image as a function of the respective rates of rotation of the first and second partial images.

Still another object of the present invention is to provide motive means for rotating first and second partial images at different rotation rates to form and reform a composite image. This is accomplishable through the incorporation of manufactured clock/watch mechanisms readily available through a variety of suppliers.

A further object of the present invention is to provide an amusing display of partial images rotating about a common axis that form a composite image from time to time. The slowly developing composite image realizes total registered focus only to dissipate while enroute towards another formation. This "changing of the guard" is not only aesthetically entertaining but also informative as the presentation of accurate time continues throughout.

A yet further object of the present invention is to provide a method for a pair of discs rotating about a common axis with each disc displaying a partial image to form a composite image from time to time.

A still further another object of the present invention is to provide a mobile device for repetitively aligning a partial image, or two, with a fixed partial image to display a composite image, always maintaining the capacity to indicate the time of day.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
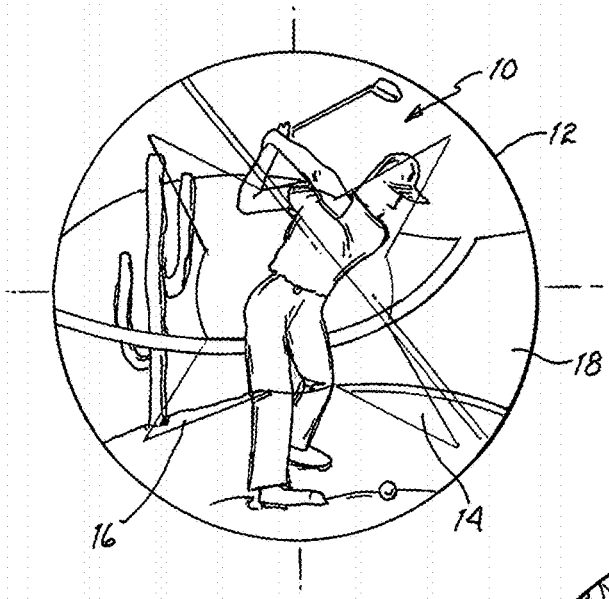
FIG. 1 illustrates a composite image that is formed by two or more partial images.

Two transparent discs (which may include background illumination) can be rotated about a center (pin) to show the array of linear compositions the images can assume on its passage between focused alignments of that image. This movement is slow and exciting as the message develops—a real challenge for any artist to capture in some form, an honorable challenge your artist can, as you suggested earlier, understand, interpret and respond. Slow definition of image can be intoxicating with its anticipation and that process of melding subtle differences between the moving layers/discs makes it possible.

The design of the total composite image will determine the complexity involved in reading the time throughout the movement of the two partial discs, one serving as the minute identifier and the other for the hours. To simplify this issue, temporary markers can be affixed to the discs and removed once the pattern of the movement is learned. Those who thrive on challenges, as with ardent puzzle solvers, might find this use of markers unworthy of consideration.

Additionally, all designs may be able to state accurate time when the discs are attached to clock/watch drives. Disc based images will rotate in synchronized (12 to 1 ratio) speeds—one of the selections being clock speed (minute and hour hands). By using the rotating letters in the outer ring (such as the "fireman 9/11" image discussed below), the outer ring acts as an hour hand, and any constantly recognizable component of the inner disc, actually the faster moving minute hand, the accurate telling of time is achieved. This can be as complicated as one desires but once the pattern is chosen and learned the reading of the information (the time) becomes privatized, mysterious, and definitely intriguing—all the while presenting a full color message (team or product allegiance, wedding photo, big fish caught, etc.) twenty-two times each day. These mechanisms can be powered by spring and/or electricity from various sources. These devices, or some derivative thereof, are common to watches and clocks, and can provide the powered drive for all examples presented.

With the analog watch/clock movement the direct overlapping of hands occurs twenty-two times per day. Therefore, the total composite image would be established at 1:05.27, 2:10.55, 3:16.22, 4:21.49, 5:27.16, 6:32.44, 7:38.11, 8:43.38, 9:49.05, 10:54.33, and 12:00.00. This would repeat for both AM and PM hours thereby allowing for accurate telling, or educated guessing, of time. This option is always available. The movements may be at set intervals, and/or may be fluid. When the hour hand moves fluidly, the above times occur. However, when the hour hand moves at a set interval, two additional overlaps may occur at around 11:55/23:55 (twenty four total), and overlaps will occur at set times of: 0:00, 1:05, 2:10, 3:15, 4:20, 5:25, 6:30, 7:35, 8:40, 9:45, 10:50, 11:55, 12:00, 13:05, 14:10, 15:15, 16:20, 17:25, 18:30, 19:35, 20:40, 21:45, 22:50, and 23:55.

Another approach to simplifying the reading of time from two constantly rotating partial discs, namely the hour and the minute disc, is to address that issue during the design stage. With attention to establishing a constantly visible marker or prominent color or some similar identifier, on each disc, to serve somewhat as a hand, the problem is easily addressed. These markers will discreetly fit into the hodgepodge of entangled moving design components and be recognized as partial hands only to the proprietor of the time-telling device.

Through the inclusion of sound bearing computer chips the visual composite can be greatly complimented. The playing of collegiate or professional football team fight songs, memorable sound bites uttered by political candidates, popular product ditties, etc. serve as examples.

Any and all of the above described techniques could be employed on any one time-telling device to simplify the reading of time.

Through the inclusion of illumination the transparent partial discs and the eventual composite composition could garner greater attention and recognition.

Figure 3:
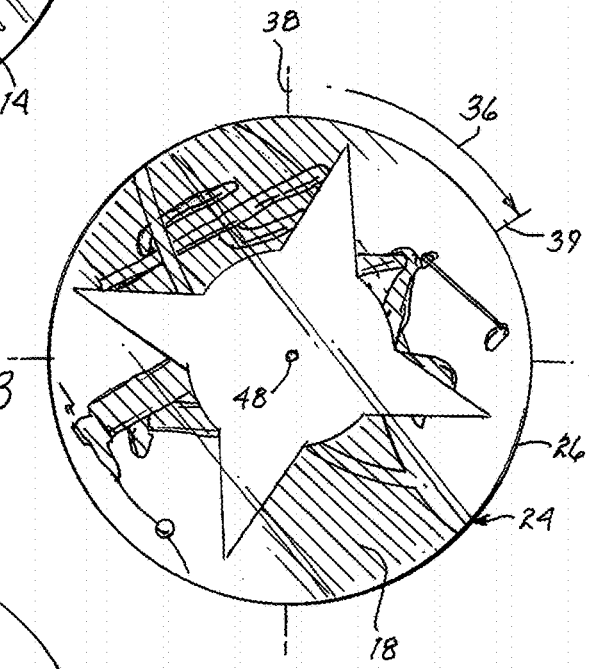
FIG. 3 illustrates a second partial image of the composite image illustrated in FIG. 1.
Figure 2:
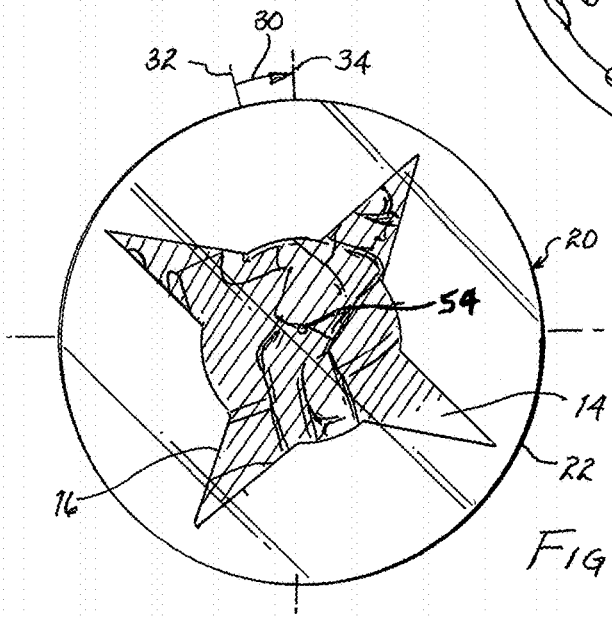
FIG. 2 illustrates a first partial image of the composite image illustrated in FIG. 1.

Referring to FIG. 1, there is illustrated a composite image 10 of a golfer on a desert golf course mounted on two superimposed discs collectively identified by numeral 12. The composite image is formed by a first partial image 14 having a star shaped outline 16. A second partial image 18 extends about outline 16 to the perimeter of disc 12. FIG. 2 illustrates a disc 20 supporting first partial image 14 located inwardly of perimeter 22 of disc 20. The area lateral of the first partial image to the perimeter of the disc is transparent. As illustrated, the first partial image depicts a part of the golfer and a part of the background. FIG. 3 illustrates the second partial image mounted on disc 24. It depicts a part of the golfer and a part of the background. As shown, the partial image extends to perimeter 26. The area inwardly of the second partial image is transparent.

Discs 20 and 24 are of transparent material, such as clear plastic, glass, etc. in the areas not containing the first or the second partial images, as set forth above. Arrow 30 at perimeter 22 extends between radial lines 32 and 34 depicted at the perimeter of disc 20 and represents relative rate of rotation. Similarly, arrow 36 at perimeter 26 of disc 24 extends between radial lines 38, 39 to depict a relative rate of rotation compared to arrow 30. By comparing the length of arrows 30 and 36, it is evident that disc 20 rotates at a lesser rate of rotation than the rate of rotation of disc 24.

Figure 4:
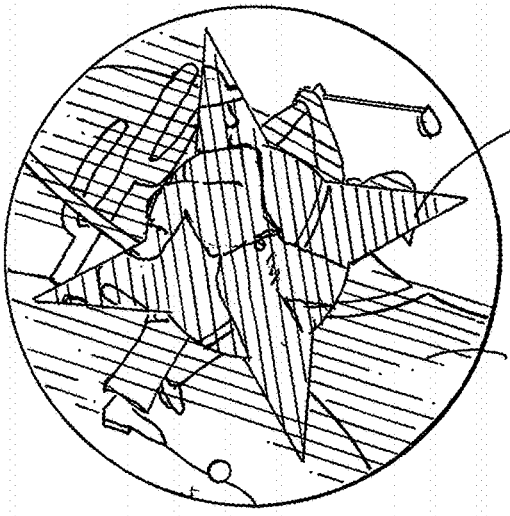
FIG. 4 illustrates superimposition of the partial images illustrated in FIGS. 2 and 3 when not aligned with one another.

FIG. 4 depicts discs 20 and 24 mounted on a common axis of rotation. First partial image 14 and second partial image 18 are not aligned with one another to depict the composite image illustrated in FIG. 1. Variations of such superimposed partial images in non-alignment with one another will be present until such time as the first and second partial images come into registration to form the composite image shown in FIG. 1. That is, until registration occurs, the partial images will be a hodgepodge.

Figure 6:
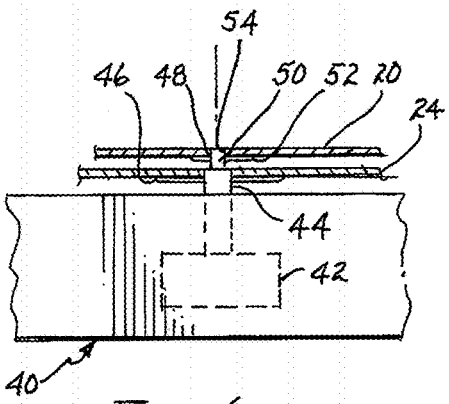
FIG. 6 illustrates a side view of two partial images mounted upon two motor driven concentric shafts.
Figure 5:
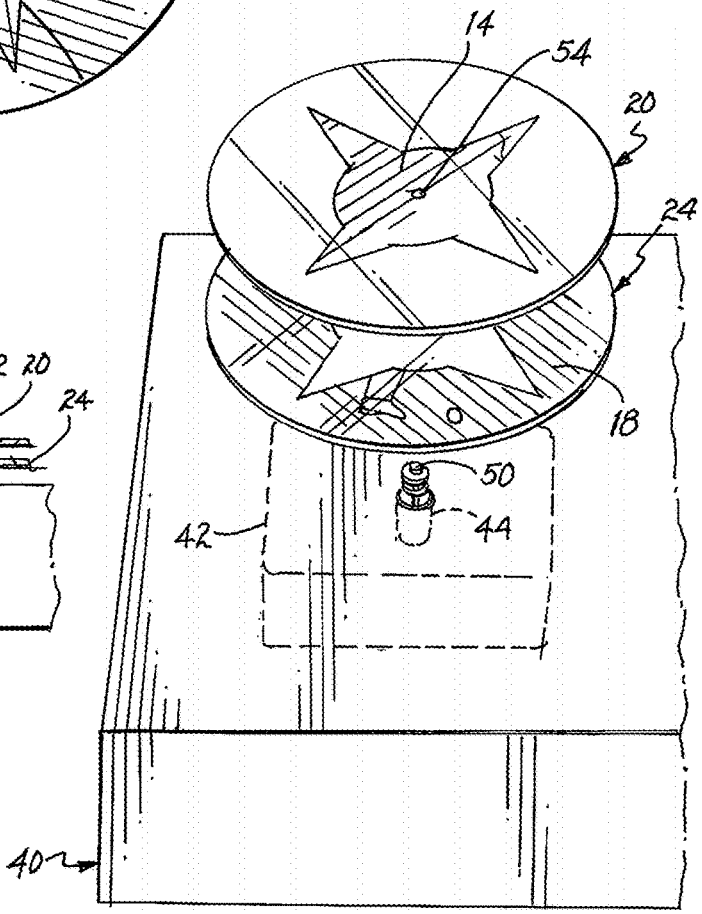
FIG. 5 illustrates a three-quarter view of two partial images on respective discs supported by concentric shafts rotating at different rates of rotation.

FIG. 5 illustrates a box, container, support or the like (40), for mounting motive means, such as an electric motor 42. The motor provides two concentric rotating shafts 44, 46 that rotate at different rates of rotation. As also shown in FIG. 6, shaft 44 may includes a roundel 45 to aid in supporting disc 24. The disc includes a central aperture 48 for penetrable engagement by and attachment to shaft 44. A mastic or adhesive of some type may be used to rigidly support disc 24 upon roundel 45 to ensure rotation of disc 24 commensurate with that of shaft 44. A rotating shaft 50, concentric with shaft 44, includes a roundel 52. Disc 20 includes an aperture 54 for penetrable engagement with shaft 50. A mastic or adhesive of some type may be used to secure disc 20 to roundel 52 to ensure rotation of the disc commensurate with the supporting shaft. The roundels and apertures mentioned above are readily available through suppliers of watch/clock mechanisms.

As pointed out above by the relative length of arrows 30 and 36, disc 20 rotates at a lesser rate of rotation than disc 24. However, at some point these discs will become aligned or superimposed whereby the first and second partial images form the composite image illustrated in FIG. 1. In particular, from time to time the partial image on rotating disc 24 will become aligned with the partial image depicted on rotating disc 20 and the composite image is momentarily created. It is to be understood that the relative rates of rotation of the discs may be at any speed but for the desired objective of telling time, specific ratio of shaft speeds is mandatory.

In the alternative, shaft 44 could be fixed, or non-rotating to support disc 24 in a static non-rotating configuration. Upon rotation of shaft 50, the partial image on disc 20 would become aligned with disc 24 to display the composite image. This configuration could be quite interesting to watch the composite image being formed and unformed.

Figure 7:
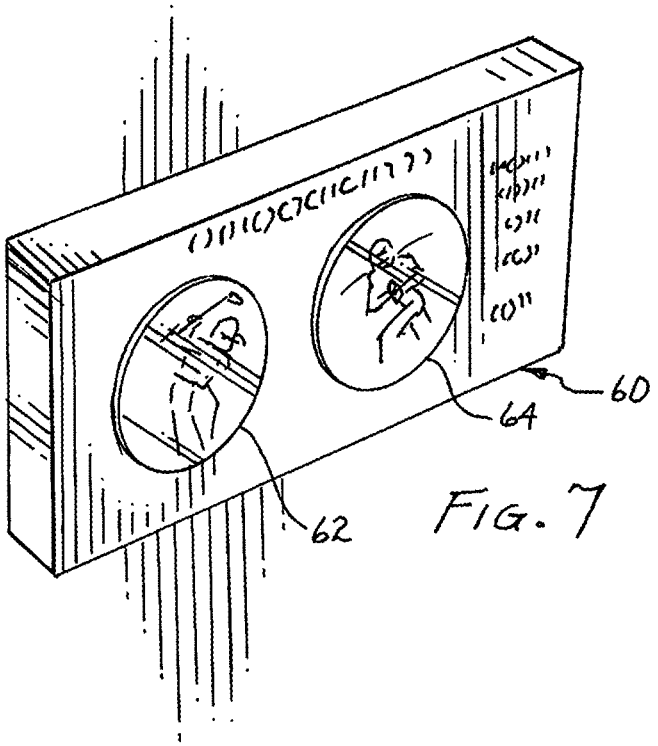
FIG. 7 illustrates a mounting containing two or more displays, each formed by rotating partial images.

Referring to FIG. 7, there is illustrated a display case 60 containing two or more composite image generating devices 62 and 64 of the type discussed above and illustrated in FIGS. 1-6. The images depicted therein would normally be different and may be of sports memorabilia, cartoon characters, etc. The location of such display case may be at a place of business, such as a bar, a man cave, a gaming room in a residence, etc.

Figure 8:
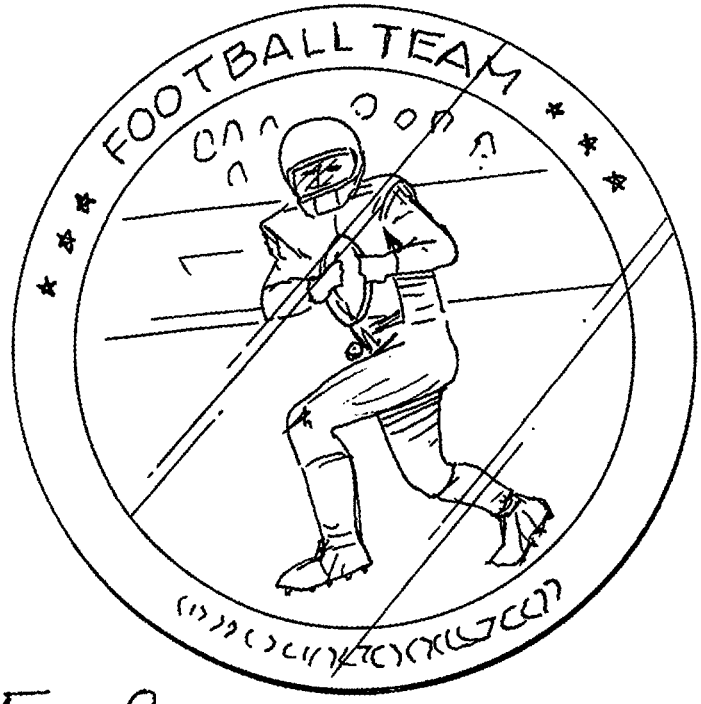
FIG. 8 illustrates a representative football player depicted as a composite image formed by two or more partial images.

FIG. 8 illustrates a composite image of two or more partial images mounted on two or more discs and depicts a running football player carrying a ball. The depiction may include the name of a football team, and other writings that may be of interest to a sports fan. The writings may be all on one disc or partially on each disc.

Figure 9:
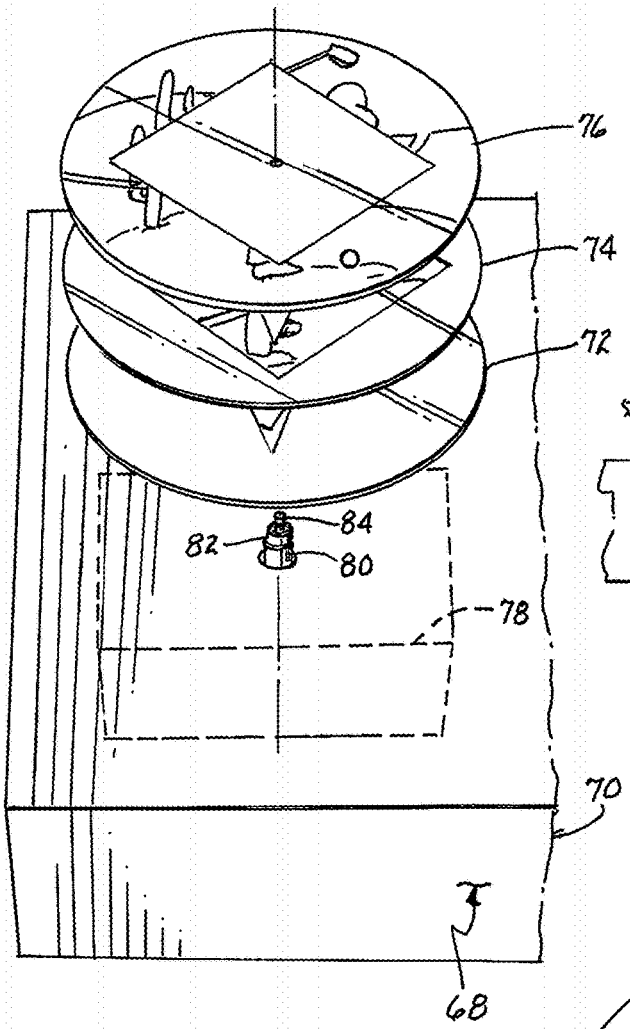
FIG. 9 illustrates three partial images mounted on respective discs supported by respective concentric shafts rotating at different rates of rotation.
Figure 10:
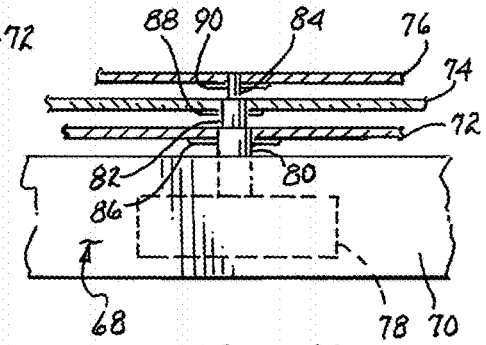
FIG. 10 is a side view of the three discs supporting the three partial images depicted in FIG. 9 and mounted upon three concentric shafts rotating at different rates of rotation.

Referring to FIGS. 9 and 10, there is illustrated a more complex composite image generating device 68 including a container 70 supporting three discs 72, 74 and 76, each disc depicting a partial image of the composite image. Motive means, such as an electric motor 78, is secured to container 70 and provides three concentric shafts, each of which rotates at a different rate of rotation. Disc 72 is mounted on shaft 80 which may include a roundel 86 to provide additional support for the disc. Disc 74 is mounted on shaft 82 which may include a roundel 88. Disc 76 is mounted on shaft 84 which may include a roundel 90.

Figure 11:
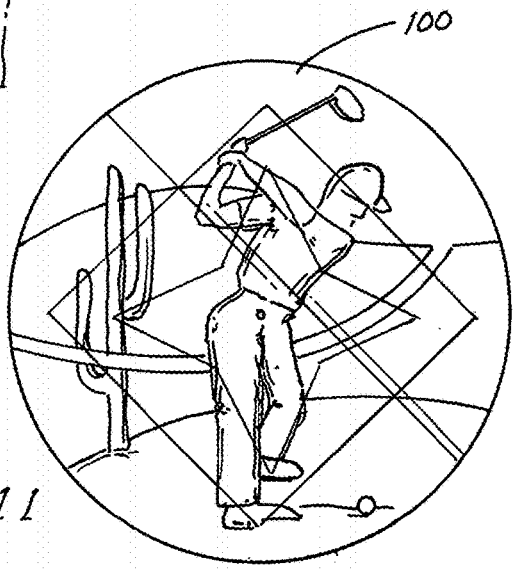
FIG. 11 illustrates the composite image formed periodically by the three partial images shown in FIGS. 9 and 10.
Figure 12:
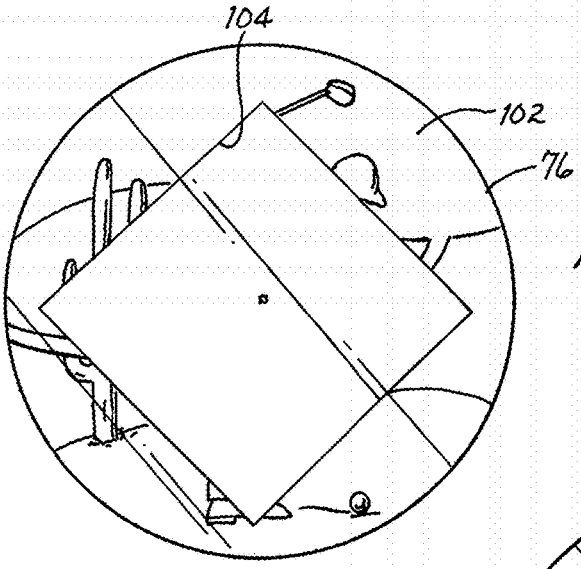
FIGS. 12, 13 and 14 illustrate the three partial images shown in FIG. 9 periodically forming the composite image illustrated in FIG. 11.
Figure 13:
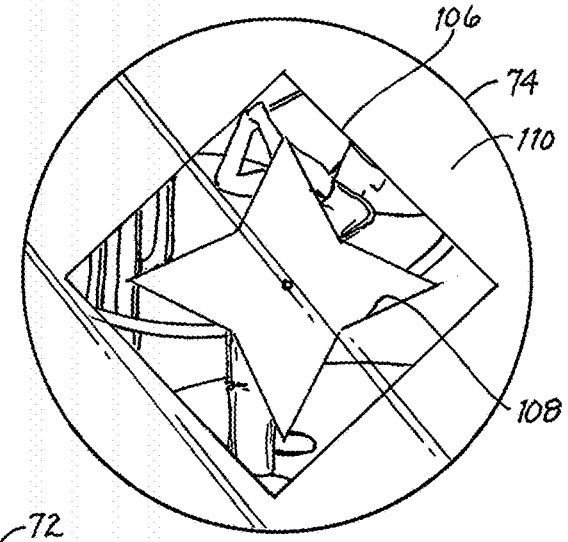
Figure 14:
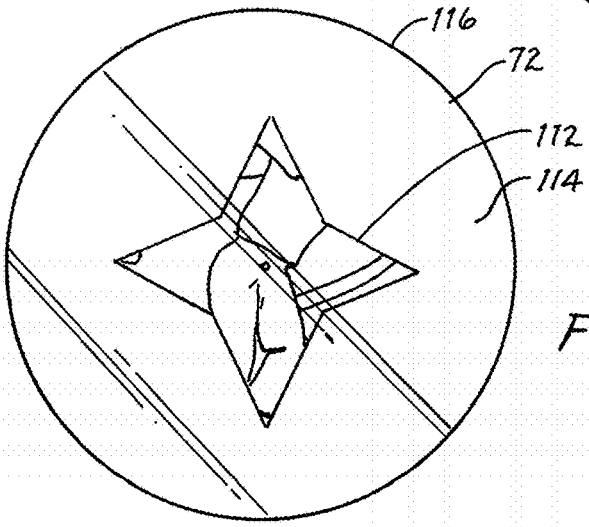
Figure 15:
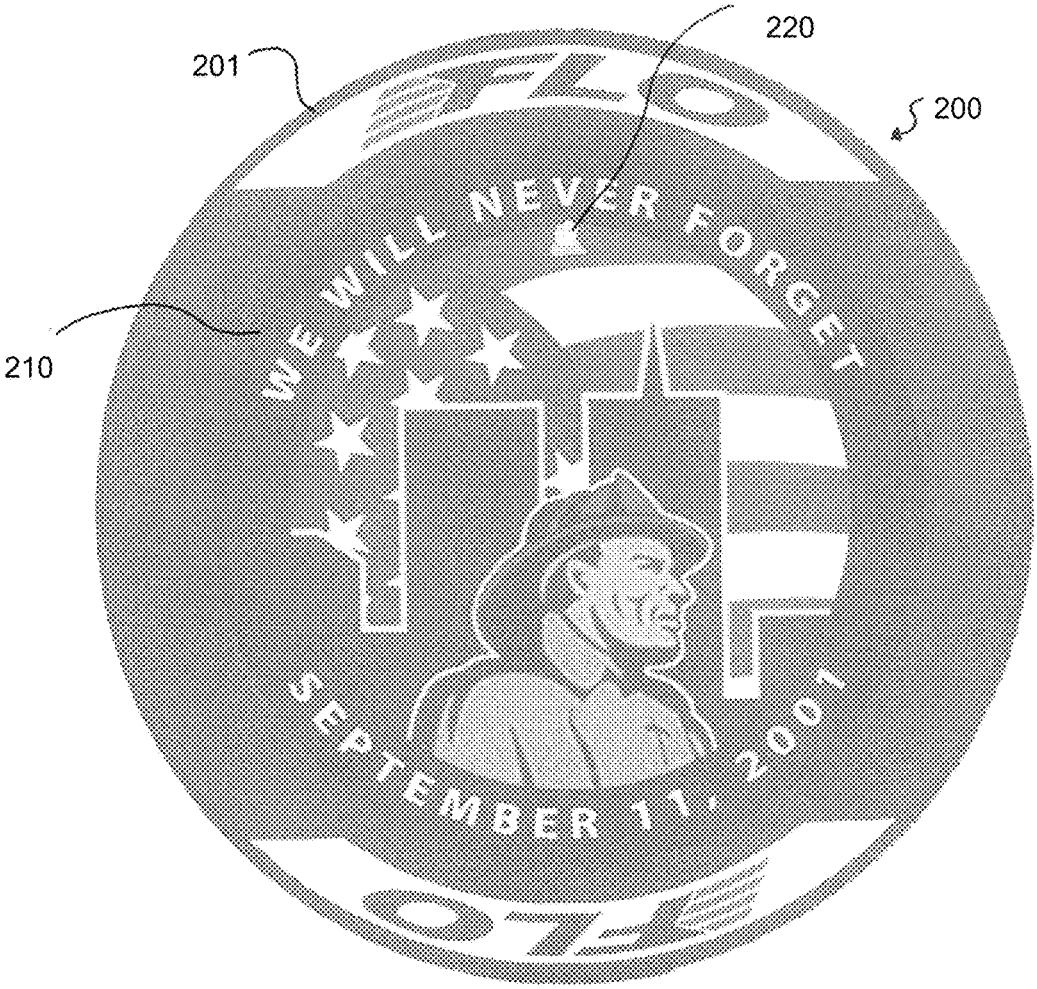
FIGS. 15 and 16 illustrate a composite image of an alternative embodiment of the present invention.
Figure 16:
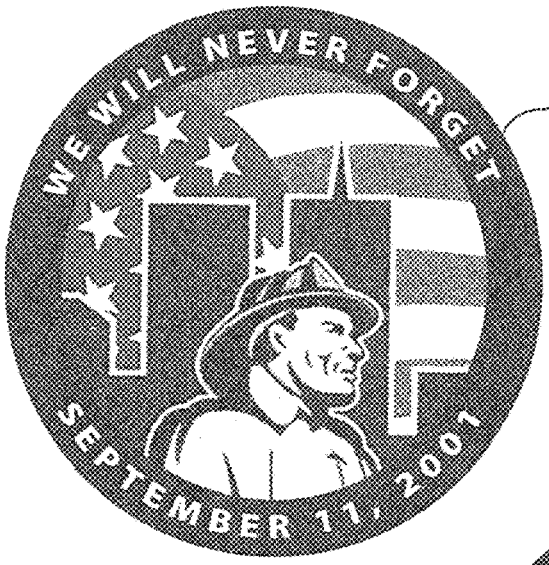
Figure 17:
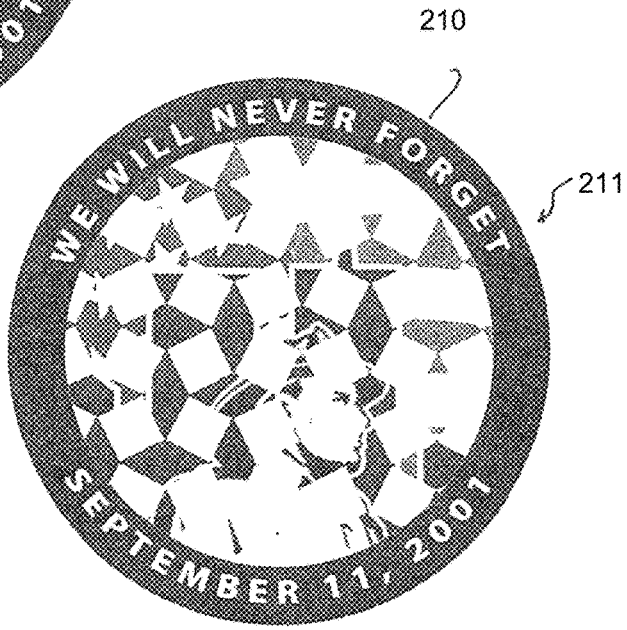
FIG. 17 illustrates a partial image of an alternative embodiment of the present invention.
Figure 18:
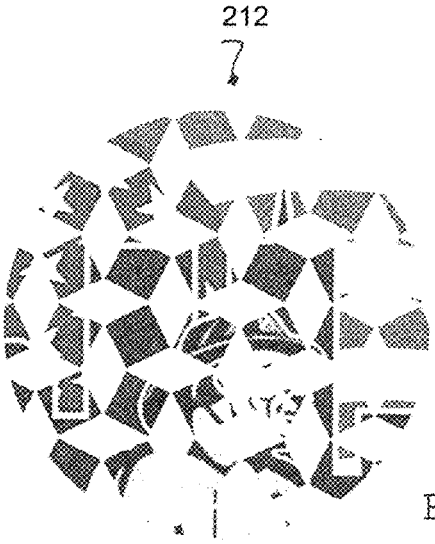
FIG. 18 illustrates a complimentary partial image of an alternative embodiment of the present invention.

Referring to FIG. 11, there is shown the composite image 100. It is formed of three separate partial images. First partial image 102 is shown in FIG. 12 and it is essentially mounted on and extends adjacent the perimeter of supporting disc 76. Disc 76 is of transparent plastic or other material and the central portion depicted as a square 104 is transparent. Disc 74 shown in FIG. 13 includes a generally square second partial image 106 mounted thereon and having a transparent central star shaped portion 108. Space 110 between second image 106 and the perimeter of disc 74 is transparent. Disc 72 shown in FIG. 14 has mounted thereon a third partial image 112 in the form of a star shape centered in the disc. Space 114 between the third partial image and the perimeter 116 of disc 72 is transparent.

Each of discs 72, 74 and 76 rotates in response to the rate of rotation of respective shafts 80, 82 and 84 extending from container 70 in response to operation of electric motor 78. The rate of rotation of each of these shafts is different. From time to time, the partial images on discs 72, 74 and 76 become aligned to provide the composite image illustrated in FIG. 11.

While the term disc has been employed to describe the base for each of the partial images, it is to be understood that other shapes for supporting the partial images could be employed. Thus, the term disc should be interpreted to include squares, triangles, etc. but primarily refers to any flat, circular, thin plate (also 'disk').

The present invention is also useful as a timepiece. Each partial image may include a marker, or indicator, to indicate to one having the prior knowledge the rotation angle of the related partial image and therefore the time. Particularly, the partial image layer associated with the hour may have a most obvious marker, but the minute and other images may also include such markers. Regardless of where and when the image appears, these markers will signify the time, and serve as surrogate clock hands. As the disks rotate, the minute disk over and faster than the hour disk. For instance, a quarter after the hour, any hour, will find the minute hand (or marker) at the #3 position. The hour hand will be indicated by a rotating mark contained on the hour disc. Together they will state accurate time to the detail of the minute.

Preferably the hour is indicated by a marker on the larger disk. The markers can be made more obvious, perhaps even left as actual hands, but may be discreetly concealed within the disjointed images. So long as one can recognize the marker(s) the telling of time is quite simple. However, it is contemplated that one who wishes to hide the time, and have a special 'key' to understand the clock, may use a portion of a partial image to track the time without use of a marker.

As can be seen in FIGS. 15 to 18, composite image 200 is shown. Background plate 201 may be placed behind and viewable around disks. Background plate 201 can serve to identify the orientation of the clock (as understood via the partial and composite images). Outer ring 210 may be formed within one of the rotating partial image disks, and may fit around (larger than) entire other partial image (disk). In this instance, outer ring 210 demonstrates a permanent message that one might convey (i.e. "WE WILL NEVER FORGET SEPTEMBER 11, 2001"). Partial image(s) may include a marker 220 as shown at the top. Hour partial image 211 and minute partial image 212 are shown. When marker is assigned to the hour partial image 211, and placed at the center top, marker serves for an easy method of determining the hour (and time). Hour can be indicated relative to the center top of outer ring 210, for instance, directly under the "V" in "NEVER".

Figure 19:
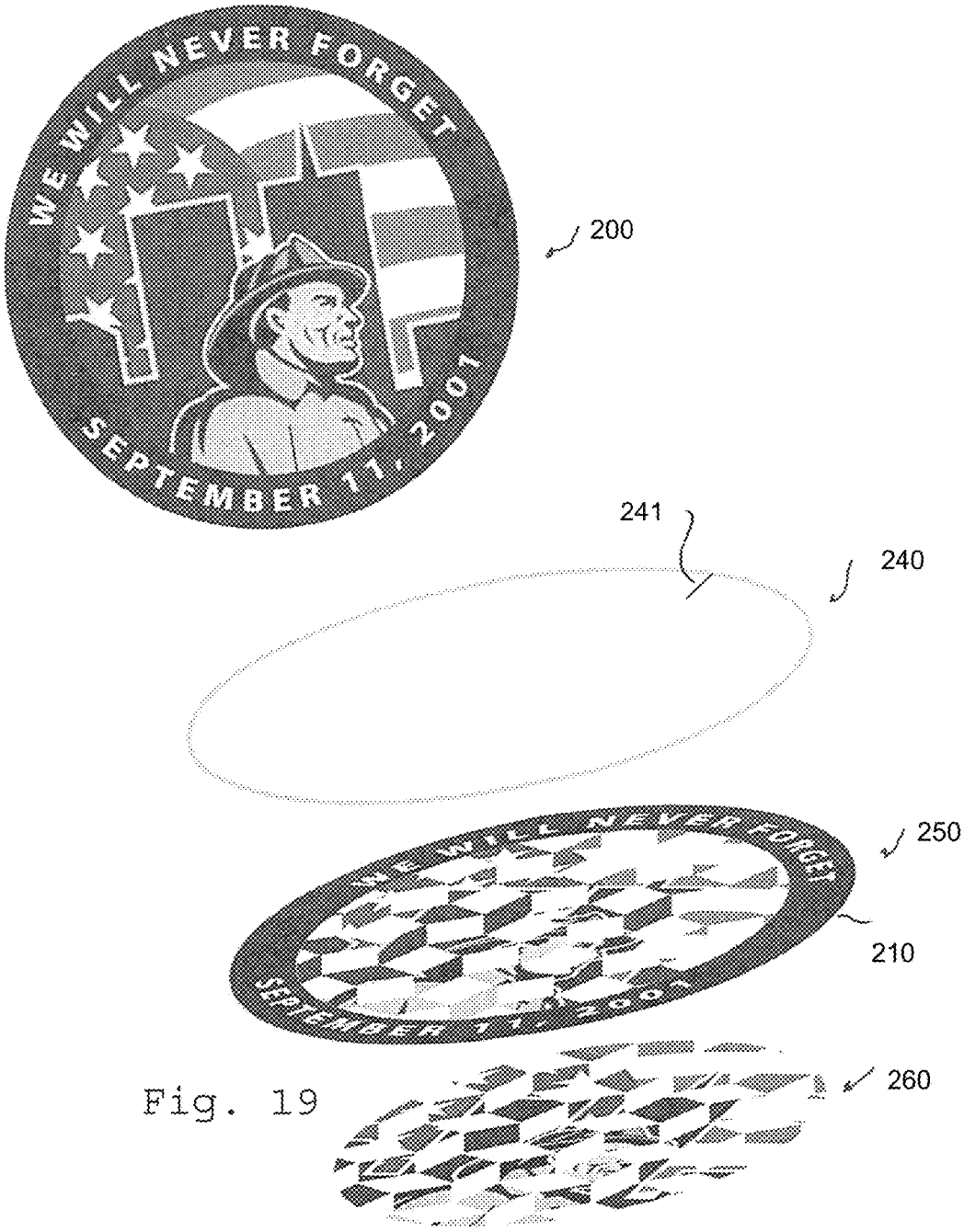
FIG. 19 illustrates an explosive view of layers within a composite image of an alternative embodiment of the present invention.

Referring to FIG. 19, composite image 200 may include various layers. Top layer 240 may include a transparency to protect the three dimensional layered structure. Transparent top layer 240 may also include a single marker 241 that can provide an easy manner of identifying the time, e.g. hour. Once the user is comfortable with the images, and can use an aspect of the partial image to understand the time, the top layer 240 with single maker 241 may be removed to further 'hide' the time. Middle layer 250 may include an attached outer ring 210, otherwise outer ring 210 may be free to move separate from middle layer 250, or otherwise fixed in position. Lower layer 260 may include another partial image, to complete composite image with middle layer 250, and may also include a marker.

Figure 20:
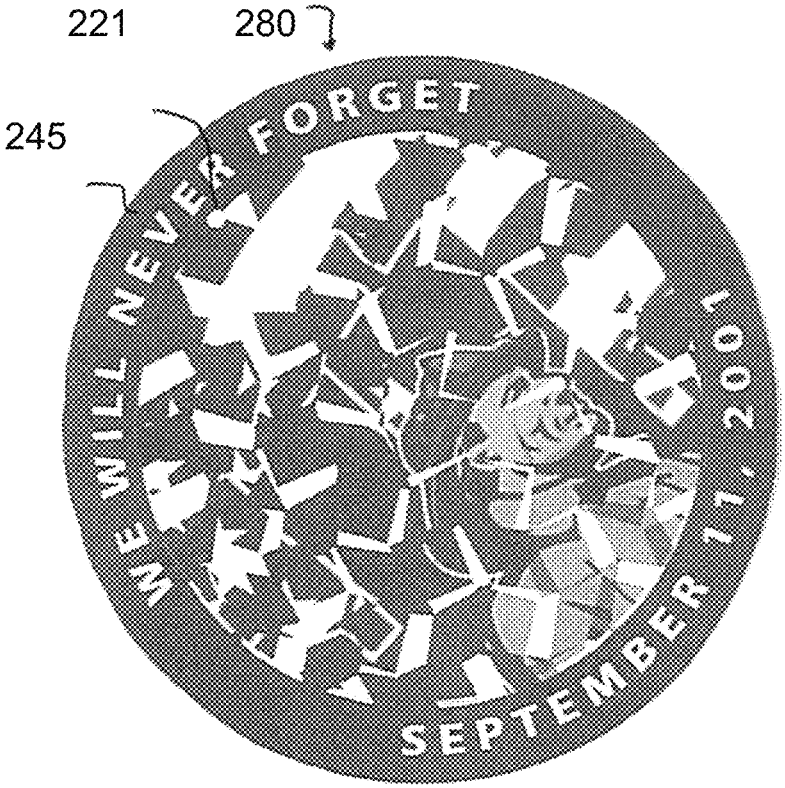
FIG. 20 illustrates a top view of composite image slightly offset of an alternative embodiment of the present invention.
Figure 21:
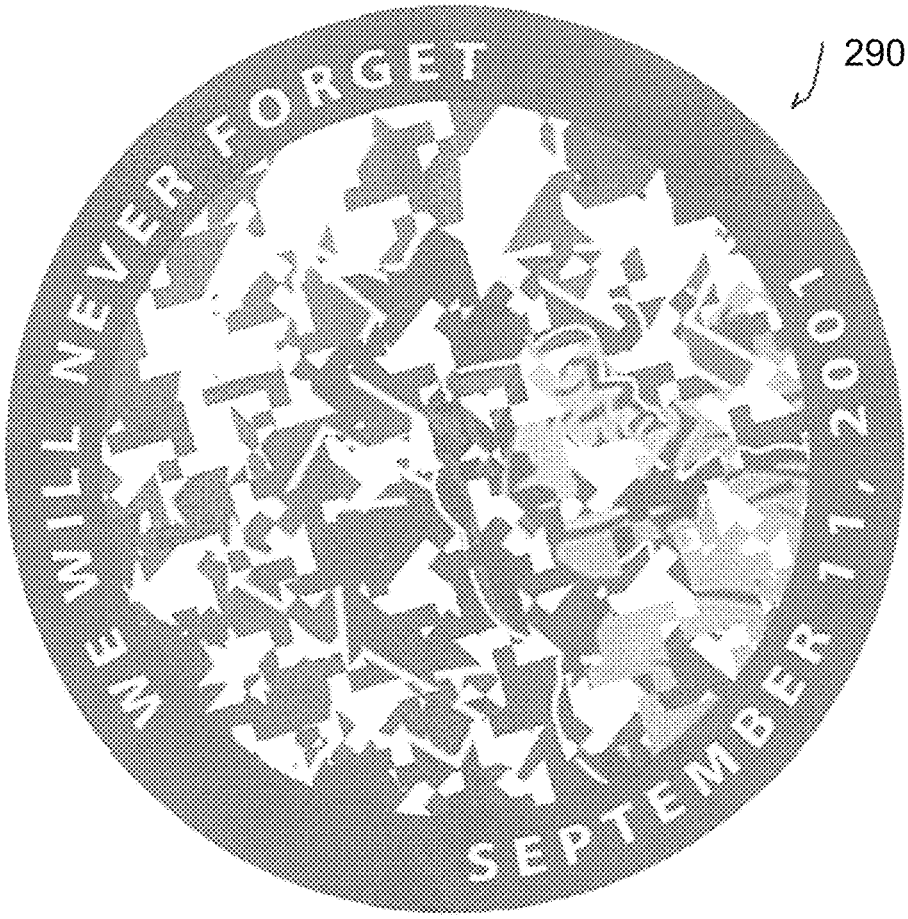
FIG. 21 illustrates a top view of composite image further offset of an alternative embodiment of the present invention.

Referring to FIG. 20, partial images 280 are slightly offset, by approximately 10 degrees. As can be seen, the composite image begins to unravel. In this instance alternative marker 221 is shown offset from the top center 245. If alternative marker 221 is associated with the minute layer (partial image) a ten-degree rotation, relative to a mostly centered hour layer, might indicate a time such as 12:02:20. Referring to FIG. 21, it is shown a further rotation of partial images 290 with the relative planes demonstrating a different time. A partial image related to the second may be used to indicate the 'ticking' of seconds. This partial images may be overlaid another partial image (such as the highest layer with a partial image, and provide a complimentary view, whereby recessed are matched in such a way that the images appear to blink with each (every other) second, or provide other special optical effects.

The concepts of the present invention may also be used on digital surfaces, and not be limited to a clock, timepiece, or wristwatch, as described above. The images may form the portion of a screensaver, whereby when the monitor 'sleeps' the partial images appear to be merely saving the screen, but also may provide a hidden clock for those familiar with its operation.

I claim:

1. Apparatus for forming a composite image from time to identifiable time, said apparatus comprising:

(a) a first partial image of the composite image;

(b) at least a second partial image of the composite image;

(c) motive means for controlled rotation of said first partial image about a common axis at a first selected rate of rotation, wherein said first selected rate of rotation corresponds to one of a revolution per minute, a revolution per hour, or two revolutions per day;

(d) further motive means for rotating said second partial image about the common axis at a second selected rate of rotation to superimpose said second partial image with said first partial image to form the composite image upon each rotation of said second partial image, wherein said second selected rate of rotation corresponds to another one of a revolution per minute, a revolution per hour, or two revolutions per day.

2. The apparatus as set forth in claim 1 including a third partial image of said composite image, yet further motive means for rotating said third partial image about the common axis at a third selected rate of rotation, wherein said third selected rate of rotation corresponds to the final remaining one of a revolution per minute, a revolution per hour, or two revolutions per day, so as to superimpose said third partial image with said first and second partial images and form the composite image from time to selected time.

3. The apparatus as set forth in claim 2 including a motor, said first motive means comprising a first rotating shaft extending from said motor, said second motive means comprising a second rotating shaft extending from said motor concentric with said first shaft, said third motive means comprising a third rotating shaft extending from said motor concentric with said first shaft.

4. The apparatus as set forth in claim 3 wherein each of said first, second and third partial images is mounted on a first, second and third disc, respectively.

5. The apparatus as set forth in claim 4 wherein the area of said first disc not containing said first partial image is transparent, wherein the area of said second disc not containing said second partial image is transparent, and wherein the area of said third disc not containing said third partial image is transparent.

6. The apparatus as set forth in claim 1 including a motor, said first motive means comprising a first rotating shaft extending from said motor, said second motive means comprising a second rotating shaft extending from said motor concentric with said first shaft.

7. The apparatus as set forth in claim 6 wherein each of said first and second partial images is mounted on a first and second disc, respectively.

8. The apparatus as set forth in claim 7 including a first roundel mounted on said first shaft for supporting said first disc and a second roundel mounted on said second shaft for supporting said second disc.

9. The apparatus as set forth in claim 8 wherein the area of said first disc not containing said first partial image is transparent and wherein the area of said second disc not containing said second partial image is transparent.

10. The apparatus as set forth in claim 1 wherein each of said first and second partial images is mounted on a first and second disc, respectively.

11. The apparatus as set forth in claim 10 wherein the area of said first disc not containing said first partial image is transparent and wherein the area of said second disc not containing said second partial image is transparent.

12. The apparatus as set forth in claim 1 wherein each of said first and second partial images comprises a marker adapted to demarcate the angle of rotation from a center.

13. A method for forming a composite image from desired time to advanced identifiable time with at least two partial images, said method comprising:

(a) rotating a first partial image about an axis at a first rate of rotation related to one of a revolution per hour, or two revolutions per day;

(b) further rotating a second partial image about the same axis at a second rate of rotation related to another one of a revolution per hour, or two revolutions per day; and (c) superimposing the first and second partial images upon each revolution of one of the first or second partial images to form the composite image at least twenty-two times each day.

14. The method as set forth in claim 13 wherein said step of rotating includes the step of rotating a first disc depicting the first partial image and wherein said step of further rotating includes the step of further rotating a second disc depicting the second partial image.

15. The method as set forth in claim 14 wherein said steps of rotating and further rotating are carried out by two concentric shafts.

16. The method as set forth in claim 15 including the step of applying timed motive means for rotating the two concentric shafts.

17. The method as set forth in claim 14 including the step of exposing the second partial image through the area of the first disc not covered by the first partial image.

18. The method as set forth in claim 13 including the step of yet further rotating a third partial image about the same axis at a third rate of rotation and wherein said step of superimposing includes the step of superimposing the third partial image with the first and second partial images upon each revolution of one of the first, second and third partial images to form the composite image.

19. The method as set forth in claim 18 wherein said step of rotating includes the step of rotating a first, a second and a third disc depicting the first, second and third partial images, respectively.

20. The method as set forth in claim 19 wherein said steps of rotating, further rotating, and yet further rotating are carried out by three concentric shafts, respectively.

21. The method as set forth in claim 13 wherein the composite image is formed twenty-four times each day at 0:00, 1:05, 2:10, 3:15, 4:20, 5:25, 6:30, 7:35, 8:40, 9:45, 10:50, 11:55, 12:00, 13:05, 14:10, 15:15, 16:20, 17:25, 18:30, 19:35, 20:40, 21:45, 22:50, and 23:55.

22. The method as set forth in claim 13 wherein the composite image is formed twenty-two times each day at 0:00, 1:05.27, 2:10.55, 3:16.22, 4:21.49, 5:27.16, 6:32.44, 7:38.11, 8:43.38, 9:49.05, 10:54.33, 12:00.00, 13:05.27, 14:10.55, 15:16.22, 16:21.49, 17:27.16, 18:32.44, 19:38.11, 20:43.38, 21:49.05, 22:54.33.

23. A method for forming a time piece to indicate the time said method comprising the steps of:

a. placing an hour disk over a center motive means;

b. rotating the hour disc relative a center at a rate of two revolutions per day;

c. indicating the angle of rotation of the hour disk relative to a top center;

d. emplacing a top transparent layer over the hour disk;

e. rotating the top transparent layer at the same rate and direction as the hour disk; and f. marking on the top transparent layer a marker to indicate the rotation of the disk relative to the top center.

24. The method of claim 23 further comprising the step of removing the top transparent layer, while maintaining the hour disk as indicator of time.

* * * * *